US009803941B2

(12) United States Patent
LaRue

(10) Patent No.: US 9,803,941 B2
(45) Date of Patent: Oct. 31, 2017

(54) ADJUSTABLE GAS SYSTEM FOR CARTRIDGE GAS ACTUATED FIREARMS

(71) Applicant: Mark C. LaRue, Leander, TX (US)

(72) Inventor: Mark C. LaRue, Leander, TX (US)

( * ) Notice: Subject to any disclaimer, the term of this patent is extended or adjusted under 35 U.S.C. 154(b) by 0 days.

(21) Appl. No.: 14/822,192

(22) Filed: Aug. 10, 2015

(65) Prior Publication Data

US 2017/0045321 A1 Feb. 16, 2017

(51) Int. Cl.
*F41A 5/28* (2006.01)
*F41A 5/20* (2006.01)

(52) U.S. Cl.
CPC . *F41A 5/28* (2013.01); *F41A 5/20* (2013.01)

(58) Field of Classification Search
CPC ..... F41A 5/28; F41A 5/20; F41A 5/26; F41A 5/24; F41A 5/18
USPC ..... 89/191.01, 191.02, 192, 193; 42/25; 138/46
See application file for complete search history.

(56) References Cited

U.S. PATENT DOCUMENTS 1,387,889 A * 8/1921 Johnston ..... F41A 5/26 89/193
3,137,204 A * 6/1964 Harvey ..... F41A 21/26 89/14.5
3,698,832 A * 10/1972 Price ..... F04D 15/0022 138/46
8,863,637 B2 * 10/2014 Hall ..... F41A 19/03 89/129.01
9,303,933 B1 * 4/2016 Lewis, III ..... F41A 5/28
2011/0061523 A1 * 3/2011 Webb ..... F41A 3/42 89/128
2014/0076144 A1 * 3/2014 Gomez ..... F41A 3/38 89/132
2014/0090283 A1 * 4/2014 Gomez ..... F41A 3/26 42/25
2015/0226502 A1 * 8/2015 Beaty ..... F41A 5/28 89/193
2015/0241149 A1 * 8/2015 McMillen, IV ..... F41A 5/28 89/193
2016/0076836 A1 * 3/2016 Young ..... F16K 31/44 89/194

* cited by examiner

*Primary Examiner* — John D Cooper
(74) *Attorney, Agent, or Firm* — James L. Jackson

(57) ABSTRACT

A propellant gas energized firearm has a gas supply passage conducting propellant gas from a gas port of a firearm barrel to an actuating chamber of a bolt carrier and bolt group having an actuating chamber. A gas key member is mounted to the bolt carrier and defines a part of the gas supply passage and has an opening intersecting the gas supply passage. A gas adjustment member is selectively moveable within the gas adjustment opening and has a gas interruption member projecting into the gas supply passage. The gas adjustment member is rotatable within the gas adjustment opening for selectively positioning the gas interruption member within the gas supply passage to selectively control the characteristics of the propellant gas delivery to the actuating chamber of the bolt carrier and bolt group.

11 Claims, 4 Drawing Sheets

ADJUSTABLE GAS SYSTEM FOR CARTRIDGE GAS ACTUATED FIREARMS

BACKGROUND OF THE INVENTION

Field of the Invention

The present invention relates generally to propellant gas actuated semi-automatic and full automatic firearms that have a bolt carrier and bolt assembly being energized by propellant gas pressure for linear movement during firing activity. The present invention also concerns a gas key component of a propellant handling system of a firearm that is mounted to the bolt carrier by retainer screws and defines a gas supply passage that is in communication with a gas port of the bolt carrier. More specifically, the present invention concerns propellant flow and pressure control and adjustment by selective positioning of a gas pressure and flow adjustment member having at least a portion thereof that is adjustably positioned within a gas supply passage of the propellant gas handling system of a firearm.

Description of the Prior Art

It is known that various changes in propellant gas actuated firearms, such as semi-automatic and automatic tactical rifles, such as the ammunition being used or the use of suppressors and other devices, significantly influence the shooting and auto cycling characteristics of such firearms. For example, the addition of a flash and noise suppressor to the barrel of a propellant gas energized rifle will change the propellant gas pressure, flow and dwell time acting on the auto-cycling mechanism and can cause the firearm to fail to function properly. Changes in the pressure, volume or timing of propellant gas entering the gas actuation chamber of the bolt carrier and bolt group of gas energized rifles, such as M-16 and AR-15 rifles, potentially alter the ammunition handling and shooting, i.e., auto-cycling characteristics of the rifles. Various types of apparatus changes have been made in propellant gas energized firearms to adjust the propellant gas handling systems, i.e., auto-cycling mechanisms of such firearms. Most of the apparatus changes have been provided in or about the gas block, which is a gas handling structure that is mounted externally of the barrel of a gas energized rifle. The gas block has internal gas passages that are in communication with a gas port that extends through the barrel structure and intersects the barrel bore enabling a portion the propellant gas within the bore of the barrel to be employed to actuate the auto-cycling mechanism of the rifle.

Tactical rifles, such as the military tactical rifles M-16 and M-4, and their semi-automatic equivalent, the AR-15 rifle, each have a bolt carrier group including a bolt carrier and bolt member that cycle within the upper receiver of the firearm by propellant gas pressure that is generated by combustion of gunpowder upon cartridge firing. The bolt carrier defines a bolt chamber within which a rear portion of a bolt member is positioned for linear and rotational movement. The bolt member is provided with gas seal rings which establish movable sealing with an internal seal surface of the bolt chamber. A space between an internal wall of the bolt carrier and the rear end portion of the bolt member constitutes a gas actuation chamber that received propellant gas via a gas supply passage system that extends to the upper receiver from the gas block member.

The bolt carrier member is linearly moveable rearwardly by the force of propellant gas pressure within the gas actuation chamber and the bolt member is urged forwardly within the bolt chamber and within the upper receiver of the firearm mechanism by propellant gas pressure acting on the bolt carrier surface and the gas seal rings of the bolt member when the firearm is discharged. As the bolt carrier is moved rearwardly by propellant gas pressure acting on it and on the bolt member, the bolt carrier further loads a buffer spring which drives the bolt carrier and its bolt forwardly when the propellant gas pressure has dissipated sufficiently that it is overcome by the spring force of the buffer system. During initial propellant gas energized rearward retraction movement of the bolt carrier the bolt member is rotated sufficiently to unlock its bolt head from a locking receptacle. The bolt member is then retracted along with the bolt carrier and during such retraction movement extracts a spent cartridge case from the cartridge chamber of the barrel and ejects the spent cartridge case through a cartridge port of the upper receiver. As the bolt carrier and bolt member are driven forwardly by the force of the buffer spring, the bolt head picks up a fresh cartridge from a magazine and feeds it into the cartridge chamber of the barrel in readiness for firing.

The propellant gas for energizing the bolt carrier and bolt group is conducted from the gas port of the barrel of the firearm, through a gas tube and through a gas supply passage of a gas key member and into the bolt chamber of the bolt carrier where it acts to move the bolt carrier and bolt member in opposite directions. The bolt carrier member defines a wall structure having a gas supply port and defines a generally planar gas key mounting surface that is intersected by the gas supply port. A gas key, also having rear or terminal end having a generally planar surface is secured to the planar surface of the bolt carrier by retainer screws and defines a gas supply passage that is in communication with the gas supply port.

Gas pressure control adjustment features have been provided to permit the user of the firearm to adjust the pressure and volume of propellant gas that is permitted to be propagated from the gas port through a gas supply tube to the gas supply passage of the upper receiver of the rifle. U.S. Pat. Nos. 8,345,626, 8,443,712 and 8,850,951 are representative of adjustable gas block apparatus for control of the propellant volume and pressure being conducted to the bolt carrier and bolt group of an auto-cycle mechanism for a firearm.

Typically, these gas adjustment features have been provided in the region of the gas block of the rifle as taught by U.S. Pat. No. 8,973,483 of Sullivan. U.S. Pat. No. 8,393,259 of Mark C. LaRue shows a gas block having a gas passage selector mechanism and being mounted to a rifle barrel having multiple gas ports to permit selective control of the characteristics of propellant gas entering the gas tube from the barrel bore. Variable gas block passage dimensions are shown to be provided in U.S. Pat. No. 8,960,069 of Soong et al by employment of a sliding regulator plate of a gas block. U.S. Pat. No. 8,950,313 of Kenney discloses a propellant gas regulator system that is provided in a gas block that receives propellant gas via two gas ports of a rifle barrel. U.S. Pat. No. 8,807,011 of Langevin illustrates the provision of another type of gas pressure adjustment mechanism for the gas block of a propellant gas energized rifle.

A related invention involving a gas key mounted to a bolt carrier seat is set forth in U.S. Pat. No. 8,991,295 of Mark C. LaRue. A port seal member is provided at the gas flow port of the bolt carrier and eliminates the leakage problems that often occur with surface-to-surface sealing of a typical gas key member. The port seal member serves to prevent any propellant gas leakage at the planar interface of the bolt carrier and gas key member, and thus effectively prevents depletion or decrease of the gas pressure that enters the bolt chamber of the bolt carrier and thus ensures against any decrease of the propellant gas actuating pressure that acts on the seal areas of the bolt member and bolt carrier member.

As mentioned above, propellant gas pressure, volume and timing characteristics is employed to cycle a bolt carrier and bolt group to move the bolt carrier member within the upper receiver against the force of a buffer and buffer spring assembly that is present within the gun stock mechanism. This propellant gas actuated cycling activity also drives the bolt member forwardly within the bolt chamber of the bolt carrier, thus moving the bolt head into the bolt locking receptacle of the barrel. During the terminal portion of the bolt closing movement the bolt member is rotated by a cam pin that extends through a cam slot of the bolt carrier and is engaged within a cam pin receptacle of the bolt member. During relative bolt carrier and bolt movement the cam pin reacts within the cam slot and causes rotation of the bolt member, causing the bolt head to establish locking engagement within the bolt locking receptacle. Unlocking rotation of the bolt member is caused by the cam pin and cam pin receptacle as the bolt carrier causes retraction movement of the bolt member.

When suppressors or other devices are mounted to the threaded muzzle end of a firearm barrel the propellant gas pressure within the bore of the barrel rather than being instantaneously vented at the muzzle of the barrel. Within a suppressor the propellant gas pressure is gradually diminished as the propellant gas enters and is processed within the multiple internal chambers or cavities within the suppressor body. Moreover, the propellant gas is reflected and agitated as it progresses serially through the suppressor to the multiple discharge openings, thus slowing the gas discharge and preventing the loud sharp noise that occurs when a suppressor is not employed. A suppressor or a different type of ammunition changes the pressure pulse characteristics within the bore of the firearm barrel and thus changes the characteristics of the propellant gas pulse that is employed for operation of the auto-cycling mechanism of the firearm. Thus, it is desirable to provide such firearms with the capability for simple and efficient adjustment of the propellant gas pulse to achieve propellant gas variations that can be coordinated with such changes.

SUMMARY OF THE INVENTION

It is a primary feature of the present invention to provide a novel semi-automatic or automatic firearm mechanism that is designed for propellant gas actuation and has a bolt carrier to which is fastened a gas key;

It is another feature of the present invention to provide a novel firearm mechanism having a propellant gas adjustment mechanism that can be easily preset to adjust the propellant gas pulse that is conducted to the auto-cycle mechanism of the bolt carrier and bolt group so that the firearm mechanism can operate correctly even when firearm or ammunition changes are made that would otherwise impede the proper function of the auto-cycle mechanism; and It is also a feature of the present invention to provide a novel propellant gas energized firearm mechanism having a propellant gas handling mechanism including apparatus defining a gas supply passage and having an adjustment mechanism in the gas supply passage that can be simply and efficiently adjusted for selective control of the characteristics of the pressure, volume and timing of propellant gas pulses that enter the gas actuation chamber of an auto-cycle mechanism.

Briefly, the various objects and features of the present invention are realized by the provision of a propellant gas energized firearm, such as the M14 or AR15, which achieves loading and extraction cycling responsive to the energy of propellant gas when a cartridge is fired within the cartridge chamber. When firearm changes occur, such as when a suppressor or other device is attached to the barrel of the firearm or when ammunition changes are made the auto-cycle mechanism of a gas energized firearm may not operate efficiently or may fail to achieve desired operational characteristics. The present invention provides for adjustment of the propellant gas supply mechanism of the firearm to compensate for such changes. A gas pressure adjustment system achieves desired selective control of gas pressure responsive bolt carrier and bolt cycling and timing and compensates for propellant gas pressure and gas propagation changes when suppressors and other devices are mounted to a firearm barrel or when the types of cartridges are changed.

Upon cartridge firing, the bullet of a cartridge is propelled through the gun barrel by the energy of expanding propellant gas that results from ignition and burning of the gun powder of the cartridge. After the bullet has traveled past a gas port in the barrel, a portion of the propellant gas enters the gas port and is conducted to the gas passages of a gas block member that is mounted externally of the barrel. From the gas block the propellant gas from the gas port is directed rearwardly through the gas supply passage of a gas tube to the receiver mechanism of the firearm and is conducted to receiver passages and to a gas supply tube of a gas key member. The gas key member is mounted to the bolt carrier by retainer screws and conducts propellant gas through a gas supply port of the bolt carrier into a gas actuation chamber so that propellant gas within the chamber acts on the bolt carrier to force it rearwardly and acts on the bolt member to force it forwardly. The bolt member can move forwardly within the bolt chamber a distance that is limited by the dimension of the cam slot of the bolt carrier within which a cam pin extends. The cam pin, which also extends through a cam pin opening or cam slot of the bolt member, reacts during relative movement of the bolt and bolt carrier for achieving locking and unlocking rotation of the bolt member.

The forward end of the gas tube is received within a tubular receptacle of a gas key member, thus causing a portion of the propellant gas to be conducted from the gas tube into an angulated section of the gas supply passage that is defined within the gas key member. From the gas supply passage, the propellant gas is conducted across the interface of the gas key member with the bolt carrier member and is conducted through a gas port of the bolt carrier member into a bolt chamber that is defined within the bolt carrier member. The propellant gas then simultaneously acts upon the exposed surface areas of the bolt carrier and bolt member that is movably positioned within a gas chamber of the bolt carrier. The propellant gas and develops sufficient force on the bolt member to drive it forwardly and to drive the bolt carrier member rearwardly against the force of a buffer and buffer spring assembly that is typically contained within the stock assembly of this type of firearm.

Typical AR15 and M16 type firearms each define an upper receiver assembly having a chamber therein that contains a bolt carrier member and permits its linear movement against the force of a buffer spring assembly. The bolt carrier member defines an internal bolt chamber within which a bolt member. The bolt member is moveable linearly and rotatably within the bolt chamber by propellant gas pressure that is transmitted from the gas tube through a gas supply passage of the gas key member and through a gas port of the bolt carrier member into the bolt chamber. The bolt member has a bolt control lug that projects into a bolt control opening of the bolt carrier and defines bolt control surfaces that impart an increment of rotation to the bolt member as it is moved linearly by propellant gas pressure after firing or by buffer spring force during bolt return.

The bolt carrier member typically defines a gas key seat having a planar surface that is intersected by the gas port. The gas key member defines a planar surface that is disposed in face-to-face relation with the planar surface of the gas key seat of the bolt carrier and is secured by retainer screw members. The gas supply passage is in communication with the gas port when the gas key is properly positioned on the bolt carrier. If desired, to minimize the potential for gas leakage at the planar interface of the gas key seat and bolt carrier, circular seal recess may be defined in the bolt carrier and about the gas port, and a corresponding circular seal recess may be defined in the gas key member, about the gas supply passage. A tubular seal member, having a generally cylindrical external configuration can be positioned with its end portions located within the circular seal recesses of the bolt carrier and gas key for enhanced gas sealing capability at the planar sealing interface of the gas key member with the planar sealing surface of a key seat of the bolt carrier.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevation view showing a propellant gas actuated tactical rifle that represents the prior art to which the adjustable propellant gas system of present invention is directed;

FIG. 2 is a partial section view showing the upper and lower receiver assemblies of the firearm of FIG. 1 and further showing the bolt carrier, bolt assembly and adjustable gas key mechanism in relation to the cartridge case of a cartridge in seated position with the bolt member;

FIG. 3 is an exploded illustration showing a bolt carrier group of a tactical firearm wherein a gas key having a propellant gas adjustment member is shown with retainer screws for retained attachment of the gas key to the bolt carrier;

FIG. 4 is a schematic isometric illustration showing a portion of the gas key member of FIG. 3 and showing the position of the gas adjustment member relative to the structure of the gas key member;

FIG. 5 is a top plan view showing the gas key member of FIGS. 3 and 4 showing the gas key member and showing the adjustment head structure of the propellant gas adjustment member;

FIG. 6 is a longitudinal section view taken along line 6-6 of FIG. 5; and FIG. 7 is an isometric illustration showing the propellant gas adjustment member in detail.

DETAILED DESCRIPTION OF PREFERRED EMBODIMENT

Figure 1:
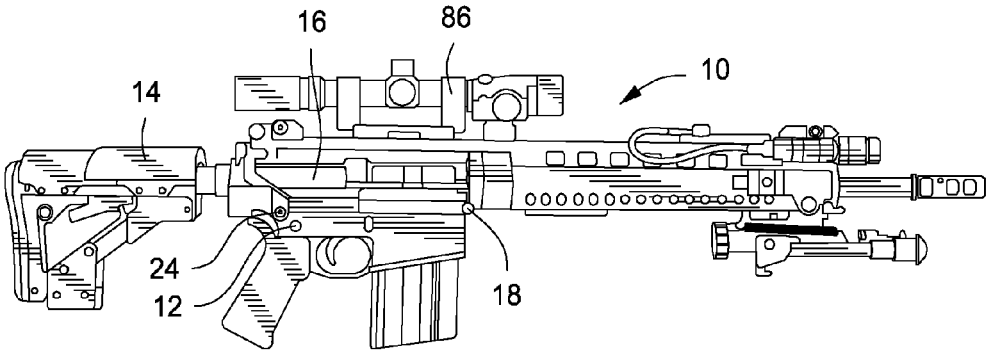
FIG. 1 (PRIOR ART)
Figure 2:
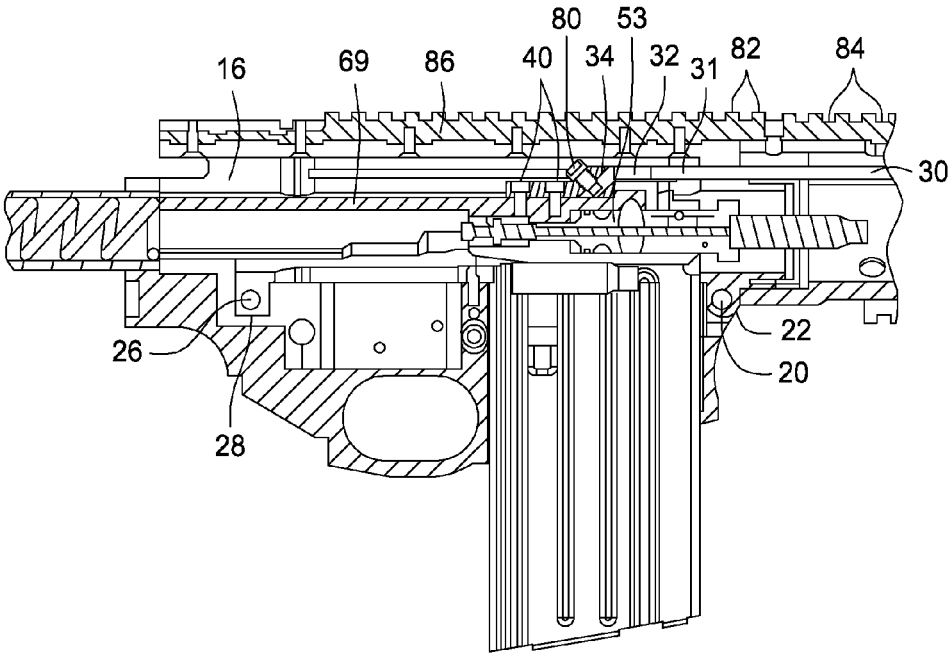

Referring now to the drawings and first to FIGS. 1 and 2, a tactical rifle type firearm representing the prior art is shown generally at 10 and incorporates a lower receiver assembly 12 having a butt-stock assembly 14. The firearm 10 also incorporates an upper receiver assembly 16 that is pivotally connected with the lower receiver 12 by a pivot pin 18 that extends through a pivot opening 20 of a pivot projection 22 that extends downwardly from a forward portion of the upper receiver assembly 16. The upper and lower receiver assemblies are further secured in assembly by a locking pin 24 that extends through the frame portion of the lower receiver assembly and extends through a locking aperture 26 that is defined by a locking projection 28 that extends downwardly from the rear portion of the upper receiver assembly 16.

It should be borne in mind that the upper and lower receiver assemblies can be simply and easily separated by removing the pivot pin 18 and the locking pin 24 or moving them to inactive positions. The pivot pin and locking pin are both accessible externally of the lower receiver member 12. The pivot pin and locking pin are typically movable to release positions with the use of a simple tool, such as a punch or pin. Disassembly of the upper and lower receiver assemblies is often done, both in servicing facilities and in the field, for the purpose of cleaning and servicing this type of tactical firearm. With the locking pin 24 moved to its release position the upper and lower receivers may be pivoted so as to expose internal components for simple and efficient cleaning.

Figure 6:
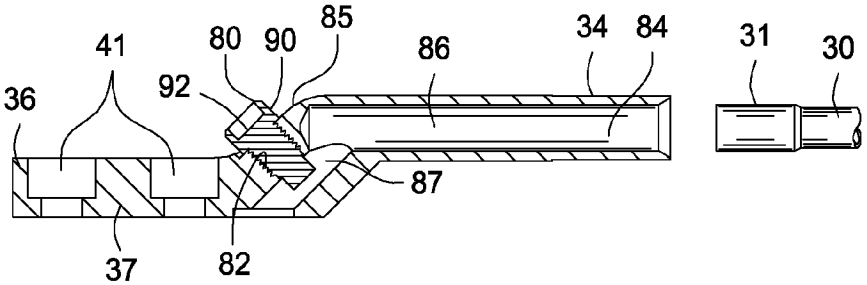

Referring now particularly to the section view of FIGS. 2 and 6, a gas tube member 30 extends rearwardly from a gas block that is mounted to the gun barrel of the firearm and receives propellant gas via a gas port in the barrel. The forward end portion of the gas tube 30 is received within a tubular gas tube receptacle 32 that is defined by a tubular member 34 projecting forwardly from a gas key member 36. As shown best in FIG. 6, the forward end of the gas tube 30, shown away from the gas tube, is typically provided with a small, generally cylindrical seal section 31 that establishes sealing engagement with the inner surface of the tubular gas tube receptacle 32. The gas tube member 30 is capable of being inserted into and withdrawn from the gas tube receptacle, thereby permitting simple and efficient disassembly of the barrel assembly of the firearm from the upper receiver assembly.

The gas key member 36 is secured within a gas key seat 37 of a bolt carrier member 38. The bolt carrier member is located for guided linear movement within a bolt carrier chamber of the upper receiver assembly 16 of the firearm 10. The rear end of the bolt carrier member 38 is in engagement with a buffer mechanism, having a buffer spring that is additionally spring loaded by the force of propellant gas during gas energized rearward movement of the bolt carrier and serves to drive the bolt carrier forward upon dissipation of propellant gas pressure acting on the bolt carrier member.

A pair of retainer screws 40 extend through screw openings 41 of the gas key member 36 and are received by threaded screw holes 42 of the bolt carrier member 38, thus securing the gas key member 36 in substantially fixed assembly with the bolt carrier member. The gas key member 34 defines a gas supply passage 44 that is in communication with the gas tube receptacle 32 and is also in communication with a gas port 46 that is defined in the wall structure 48 of the bolt carrier member. The gas port 46 serves to conduct propellant gas into a bolt chamber 50, within which a rearward portion of a bolt member 52 is received. The space between the rear portion of the bolt member and an inner wall of the bolt carrier constitutes a propellant gas chamber 53 that is in communication with a gas supply port 55 that is aligned with the angulated gas supply passage 87 of the gas key member 36. Thus, propellant gas pressure communicated into the propellant gas chamber 53 acts on the forward end of the bolt carrier, moving the bolt carrier rearwardly and on the rear end of the bolt member, moving the bolt member forwardly within the bolt chamber 50.

Figure 3:
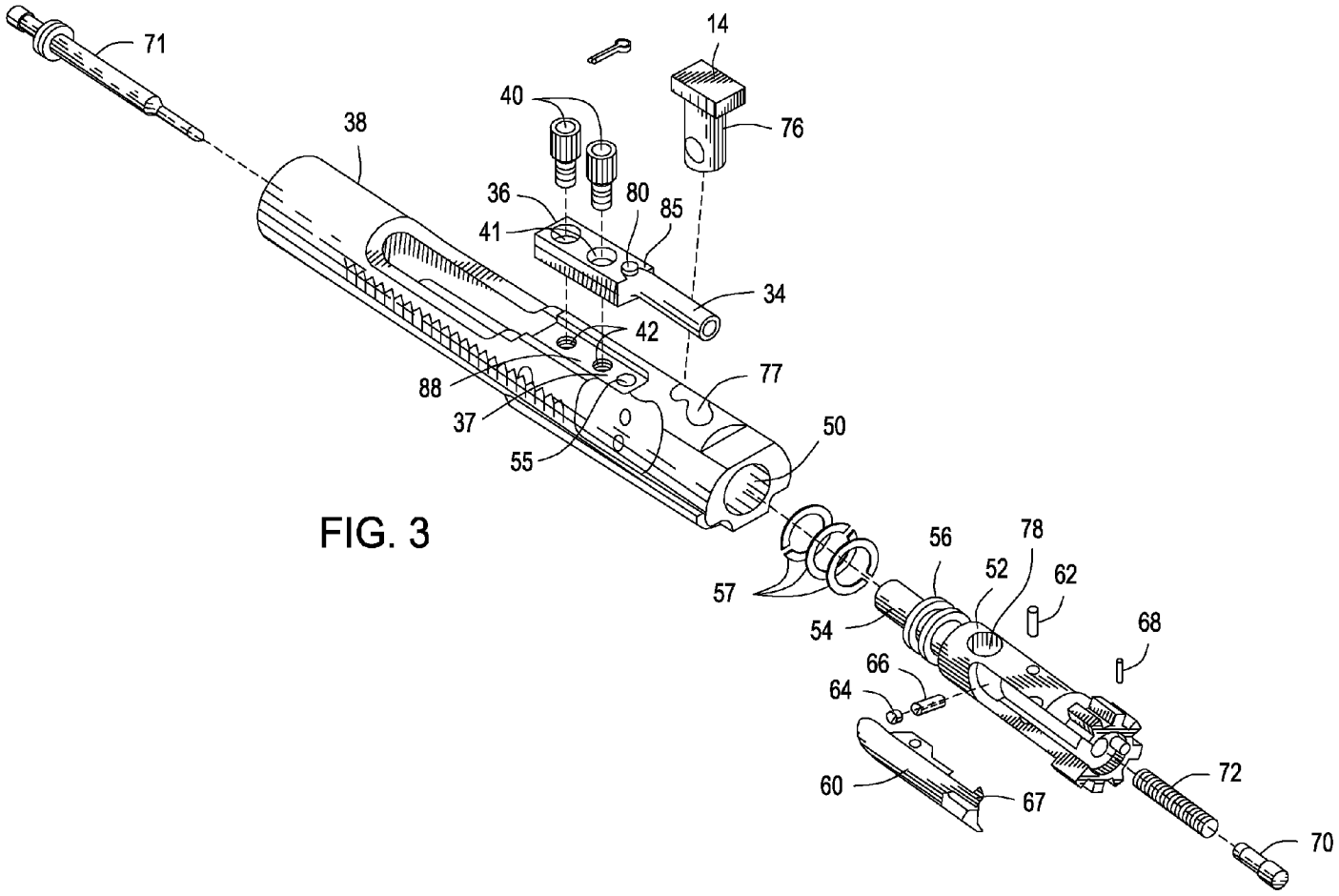
Figure 4:
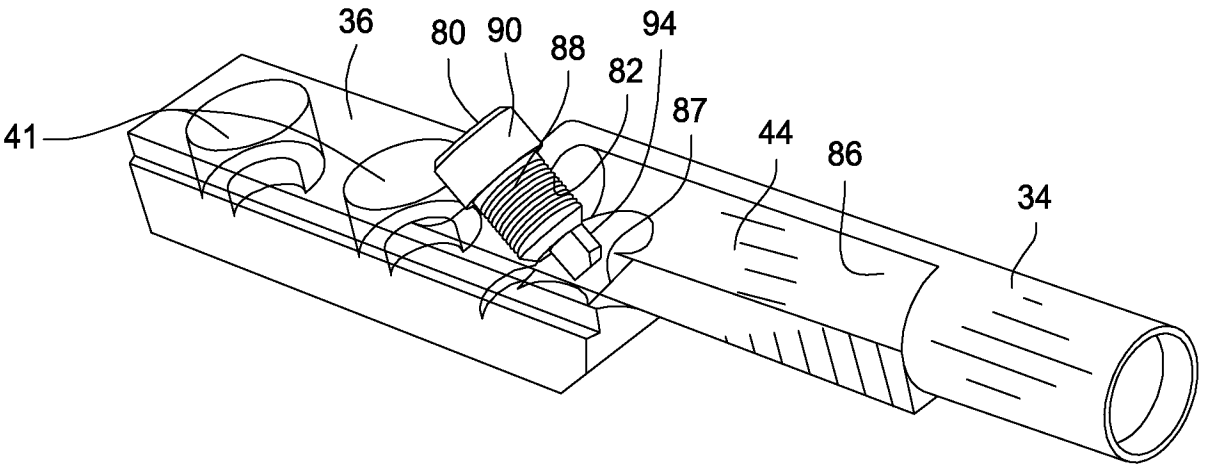
Figure 7:
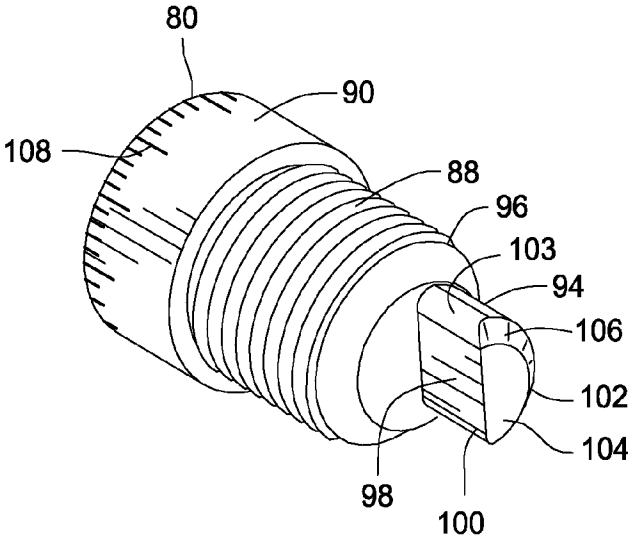

The relation of the bolt carrier member and bolt member 52 is best understood with reference to the exploded illustration of FIG. 3. According to FIG. 3, the bolt member 52 has a rearward projection 54 having a seal carrier section 56 that provides support for a plurality of gas ring members 57 that effect a dynamic seal with an internal sealing surface 58 of the bolt carrier member. An extractor member 60 is pivotally mounted to the bolt member by an extractor pin 62 and is urged in one pivotal direction about the extractor pin by means of an extractor spring 64 that is positioned by an extractor spring insert 66. A cartridge base engaging member 67 of the ejector member engages within the circular groove of a cartridge case so that rearward movement of the bolt member causes extraction of a spent cartridge case from the cartridge chamber of the barrel of the firearm. Cartridge extraction is enhanced by the presence of propellant gas pressure that tends to drive the spent cartridge rearwardly, thus essentially loosening the cartridge case within the cartridge chamber of the firearm barrel. At the time the spent cartridge case is loosened, but not yet extracted from the cartridge chamber, the propellant gas pressure will have decreased essentially to zero so that virtually no propellant gas is liberated from the cartridge chamber.

Positioning of the extractor member is also controlled by an extractor roll pin 68. An ejector member 70 is movably secured to the bolt member, with its movement being controlled by an ejector spring 72. A firing pin 71 is located within a central passage of the bolt member with a forward portion projecting through a bolt passage opening 73. Seal rings 69 are carried by the firing pin and establish a seal within a firing pin passage of the bolt member. During extraction of a spent cartridge case, the rearwardly moving cartridge case contacts an ejector member and begins to pivot the cartridge case toward a cartridge case ejection port of the upper receiver and the cartridge case comes into contact with angulated receiver structure which causes ejection of the spent cartridge case through the ejection port of the upper receiver of the firearm.

The cam-pin 14 has a generally cylindrical pin member 76 that extends through a cam-pin opening 77 of the bolt carrier member 38 and engages within a position control recess 78 of the bolt member 52. The cam-pin ensures rotation of the bolt member to its locked position when the bolt member is near its forward most position, causing multiple locking lugs of the bolt head to establish locking engagement within the locking recess adjacent the cartridge chamber. Thus, upon firing of a cartridge the initial presence of high pressure propellant gas acting through the cartridge case on the bolt member will be resisted by the locked condition of the bolt locking mechanism until such time that propellant gas has actuated the bolt carrier and bolt group for unlocking and retraction. The cam-pin 74 also reacts within the cam-pin slot 76 of the bolt carrier during gas energized rearward bolt carrier movement and causes unlocking rotation of the bolt member as the bolt carrier member is moved rearwardly to facilitate bolt unlocking and retraction.

Figure 5:
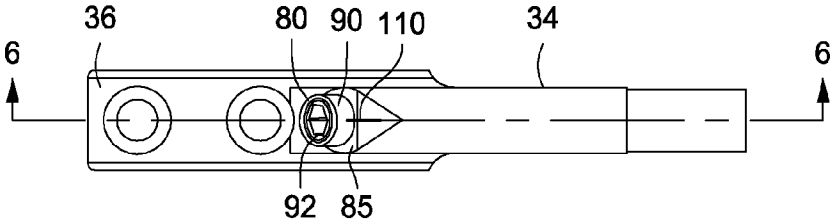

As mentioned above, an important feature of the present invention is the selective control of propellant gas actuation of the bolt carrier member by selective positioning of a gas pressure and flow control adjustment member 80 within a propellant gas supply passage 86 that extends from the gas block of the firearm barrel to the bolt carrier. Preferably the gas pressure control adjustment member 80 is mounted to an angulated section 85 of the gas key member 36, as best shown in FIGS. 5 and 6, and has a gas interruption member 94 that projects into the angulated gas supply passage section 87 that can be selectively positioned to alter or set propellant gas propagation to alter or set the characteristics of propellant gas entering a gas receiving chamber within the bolt carrier. The gas key member 36 is mounted to the bolt carrier member 38 by retainer screws 40 that are received by screw holes 41 of the mounting base portion 37 of the gas key member.

The gas interrupting member 94 is selectively and rotatably positionable within the gas supply passage section 87 cause changes in the pressure and flow characteristics of the gas pressure that is delivered to a gas pressure chamber within the bolt carrier for selectively controlling the timing of the cartridge handling, firing and extraction mechanism of the firearm, which is typically referred to as the bolt carrier and bolt group. It is to be borne in mind that a propellant gas adjustment member may be located at any selected location along the length of the gas supply passage 84 from the gas block to the bolt carrier or within the bolt carrier itself without departing from the spirit and scope of the present invention.

The gas key member 36 defines an internally threaded receptacle 82 that intersects and establishes communication with the inclined or angulated portion 85 of the gas supply passage 86 of the gas key member. The gas pressure control adjustment member 80 has an externally threaded section 88 that is engaged within the internally threaded receptacle 82, with the internal and external threads having a rather tight fit that requires significant manual force for movement of the gas pressure control adjustment member 80 in either rotating direction and prevents the gas pressure control adjustment member 80 from being inadvertently rotated by the shock forces and/or thermal changes that occur as the firearm is repeatedly discharged. The gas pressure control adjustment member 80 also defines an adjustment head portion 90 having a tool engagement receptacle 92 for receiving an adjustment tool, such as a hex or Allen-wrench, star drive wrench, Torx-drive wrench, screw driver or any other similar tool that is typically employed to tighten or loosen screws.

At its inner end the gas pressure control adjustment member 80 has a gas interrupting projection 94 that is located at least partially within the angulated section 87 of the gas supply passage 84 and serves to interrupt the unrestricted propagation of propellant gas within the inclined or angulated portion 84 of the propellant gas passage 86. It should be noted that the gas interrupting projection 94 does not achieve complete shut-off within the gas passage, but rather simply alters the characteristics of pressure and flow as desired by the user of the firearm. The gas interrupting projection 94 is laterally offset with respect to a circular inclined end surface 96 and defines a generally planar gas deflection surface 98 that can be selectively oriented within the gas passage section 84 by rotating the gas pressure control adjustment member 80 with an adjustment tool.

The gas pressure control adjustment member 80 has adjustment surfaces of various geometry, thus permitting a wide range of selective control features. The generally planar gas deflection surface 98 has a rather sharp intersection 100 with a curved or arcuate surface 102. The curved or arcuate surface 102 has a rather broad or smoothly contoured intersection 103 with the generally planar gas deflection surface 98. The gas pressure control adjustment member 80 defines a generally planar end surface 104 and has a curved tapered surface 106 that intersects the planar gas deflection surface 98 and the curved or arcuate surface 102. Since the gas pressure control adjustment member 80 has 360° of rotational adjustment by virtue of its threaded engagement within the internally threaded receptacle 82 the various surfaces and edges of the gas pressure control adjustment member 80 can be adjusted to a variety of different control positions to achieve desired timing control of the bolt carrier and bolt group of the firearm. These control positions may be accurately preset or confirmed by alignment of position adjustment indicia lines or marks 108 on the adjustment head 90 with a reference line or mark 110 on an external angulated surface 85 of the gas key member. Moreover, when the gas pressure or flow and its timing are changed, such as when a suppressor or other rifle component is employed or when the ammunition is changed, the gas pressure control adjustment member 80 can be selectively positioned to compensate for these changes and facilitate proper and efficient gas energized firearm auto-cycling.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A propellant gas energized firearm having an auto-cycle mechanism, comprising:

a firearm barrel having a gas port located along the length thereof;

a gas block being mounted externally of said firearm barrel and having a propellant gas passage in gas receiving communication with said gas port;

a receiver within which a gas energized bolt carrier and bolt are disposed for gas energized cycling movement, said bolt carrier defining a bolt passage having a bolt member movably positioned therein and having a gas supply port in communication with said bolt passage;

a gas key member defining a gas supply passage extending from said propellant gas passage of said gas block to said gas supply port of said bolt carrier; and a gas adjustment member being movably mounted to said gas key member and having a gas interruption portion thereof positioned for selective adjustment within said gas supply passage to selectively control propellant gas propagation through said gas supply passage and into said internal bolt passage of said bolt carrier;

a curved outer surface and a generally planar surface being defined by said gas interrupting portion;

a broad smoothly contoured curved surface establishing intersection with said curved outer surface and said generally planar surface;

a sharp edge establishing intersection with said curved outer surface and with said generally planar surface; and said gas adjustment member being rotatable to selectively locate said curved outer surface, said broad smoothly contoured curved surface, said generally planar surface and said sharp edge within said gas supply passage and thereby select propellant gas flow and pressure and establish desired propellant gas conditions within said gas chamber and selectively control bolt carrier and bolt actuation.

2. The propellant gas energized firearm of claim 1, comprising:

said gas key member being mounted to said bolt carrier and defining a portion of said gas supply passage;

said gas key member defining a gas adjustment receptacle in communication with said gas supply passage; and said gas adjustment member being received within said gas adjustment receptacle and having said gas interruption portion being an integral portion thereof positioned within said gas supply passage and being selectively rotatably positioned within said gas supply passage for control of propellant gas energization of said bolt carrier and bolt member.

3. The propellant gas energized firearm of claim 1, comprising:

said bolt carrier defining a bolt key mount;

said bolt key member having a portion of said gas supply passage therein;

said bolt key member defining said gas adjustment receptacle; and said gas adjustment member being rotationally mounted within said gas adjustment receptacle for selective flow adjusting movement within said gas adjustment receptacle and having said gas interruption portion projecting into said gas supply passage and being selectively rotatably positioned to establish desired variations in gas flow characteristics.

4. The propellant gas energized firearm of claim 1, comprising:

said gas adjustment member defining an axial center-line; and said gas interruption portion being positioned eccentrically with respect to said center-line.

5. The propellant gas energized firearm of claim 1, comprising:

said gas key member mounted in substantially fixed relation with said bolt carrier and having an angulated tubular section defining a portion of said gas supply passage, said angulated tubular section having an internally threaded opening intersecting said gas supply passage; and said gas adjustment member having an externally threaded section being positioned within said internally threaded opening and having said gas interruption portion extending into said gas supply passage and being selectively positionable within said gas supply passage to selectively position said curved outer surface, said generally planar surface and said sharp edge in selectively oriented relation within said gas supply passage and adjust the flow of propellant gas through said gas supply passage and achieve desired changes in the propellant gas being supplied to and acting on said auto-cycle mechanism of the firearm upon firing of a cartridge.

6. The propellant gas energized firearm of claim 1, comprising:

said gas adjustment member defining an axial centerline; and said gas interruption portion being eccentrically located with respect to said axial centerline and having a plurality of surface and edge geometries that are selectively positioned relative to propellant gas flow within said gas supply passage to control propellant gas flow and pressure to said auto-cycle mechanism.

7. A propellant gas energized firearm, comprising:

a firearm barrel having a gas port located along the length thereof;

a gas block being mounted externally of said firearm barrel and having a propellant gas passage in gas receiving communication with said gas port;

an auto-cycle mechanism having a gas energized bolt carrier and bolt and a gas receiving actuation chamber being exposed to both said bolt carrier and said bolt;

a propellant gas supply conduit conducting propellant gas from said gas block to gas receiving actuation chamber;

a gas key member being mounted to said bolt carrier and having an internal gas supply passage conducting propellant gas to said gas receiving actuation chamber, said gas key member having an angulated tubular section defining a portion of said internal gas supply passage and having an internally threaded gas adjustment receptacle in communication with said internal gas supply passage within said angular tubular section; and a gas adjustment member having an externally threaded section being threaded and rotationally positionable within said internally threaded gas adjustment receptacle of said gas key member and having a gas interrupting member projecting therefrom and having a curved surface and an intersecting generally planar surface defining an intersecting edge being positioned for selective gas flow adjustment within said gas supply passage to selectively control the characteristics of propellant gas being conducted through said internal gas supply passage and into said gas receiving actuation chamber of said bolt carrier.

8. The propellant gas energized firearm of claim 7, comprising:

said gas key member being mounted to said bolt carrier and having an angulated tubular section defining a portion of said gas supply passage;

said angulated tubular section of said gas key member defining said gas adjustment receptacle and being in communication with said gas supply passage within said angulated tubular section; and said gas adjustment member being secured by threaded engagement within said gas adjustment receptacle and having said gas interruption member positioned for rotational adjustment within said gas supply passage section of said angulated tubular section of said gas key member and selectively rotationally positioning said curved surface, said intersecting generally planar surface and said intersecting edge within said gas supply passage for selectively adjusting propellant energized pressure and flow control of propellant gas and causing selective energization of said bolt carrier and bolt member during auto-cycling activity of said firearm.

9. The propellant gas energized firearm of claim 7, comprising:

said gas adjustment member defining an axial center-line; and said gas flow interrupting member projecting from said gas adjustment member being positioned eccentrically with respect to said axial center-line and being rotatable within said gas supply passage about said axial center-line.

10. The propellant gas energized firearm of claim 7, comprising:

said gas adjustment member being a one-piece member and extending into said gas supply passage of said angulated tubular section, being selectively rotationally positionable within said gas supply passage to adjust the flow of propellant gas through said gas supply passage and achieve desired changes in the pressure and flow characteristics of the propellant gas being supplied to and acting on said auto-cycle mechanism of the firearm upon firing of a cartridge.

11. The propellant gas energized firearm of claim 10, comprising:

said gas interrupting member being selectively rotatable to position said curved surface, said generally planar surface or said intersecting edge selectively within said gas supply passage.

* * * * *